United States Patent [19]

Miyata

[11] 4,453,058

[45] Jun. 5, 1984

[54] LEAF SWITCH COVER

[75] Inventor: Muneyoshi Miyata, Tokyo, Japan

[73] Assignee: Mitsuku Denshi Kogyo Kabushiki Kaisha, Tokyo, Japan

[21] Appl. No.: 449,200

[22] Filed: Dec. 13, 1982

[30] Foreign Application Priority Data

Dec. 15, 1981 [JP] Japan ..... 56-202974
Mar. 16, 1982 [JP] Japan ..... 57-41575

[51] Int. Cl.[3] ..... H01H 1/26
[52] U.S. Cl. ..... 200/283; 200/302.1
[58] Field of Search ..... 200/283, 302, 246, 250

[56] References Cited

U.S. PATENT DOCUMENTS

| | | | |
|---|---|---|---|
| 2,251,056 | 7/1941 | Irwin | 200/302 |
| 3,246,112 | 4/1966 | Adams et al. | 200/302 |
| 3,284,586 | 11/1966 | Gover | 200/302 |
| 3,971,902 | 7/1976 | Wulf et al. | 200/246 X |
| 4,196,328 | 4/1980 | Ishikawa | 200/283 X |

FOREIGN PATENT DOCUMENTS

| | | | |
|---|---|---|---|
| 1074124 | 1/1960 | Fed. Rep. of Germany | 200/283 |
| WO80/00048 | 1/1980 | PCT Int'l Appl. | 200/302 |

*Primary Examiner*—John W. Shepperd
*Assistant Examiner*—Renee S. Kidorf
*Attorney, Agent, or Firm*—Oblon, Fisher, Spivak, McClelland & Maier

[57] ABSTRACT

A cover for a leaf switch comprises a cover body having defining a space which receives contact elements of the leaf switch. The cover body engages with a movable contact element to allow the leaf switch to be actuated as a result of movement of the cover body and receives a fixed contact element. The fixed contact element is kept still when the movable contact element is moved together with the cover body. The arrangement described had been found to be effective in preventing or reducing contamination of the contact elements of the leaf switch by dust.

15 Claims, 17 Drawing Figures

LEAF SWITCH COVER

BACKGROUND OF THE INVENTION

1. Field of the Invention

This invention relates to a cover for a leaf switch, and more particularly to a cover for a leaf switch capable of sealing and enclosing contact elements of the leaf switch effectively to prevent dust reaching the contact elements, while allowing the leaf switch to operate effectively.

2. Description of the Prior Art

Recently, large numbers of different kinds of micro-switches and leaf switches have been used in various electronic and electrical devices such as electronic computers, electronic acoustic units and the like. The use of such switches is rapidly increasing.

Micro-switches conventionally used are generally constructed to enclose their contact mechanism in a small case formed of plastics, to make them more dust-proof. However, in such a conventional micro-switch the contact mechanism in the small case must be operated from the outside of the case. This results in the conventional micro-switch being disadvantageous in that its construction is complicated, its strength is poor, it lacks durability and is costly.

Leaf switches, on the other hand, generally include a switch mechanism which comprises spring-loaded contact elements constructed in a simple manner and open to the atmosphere. Leaf switches tend to last longer, work better and cost less than micro-switches. However, the conventional leaf switch is disadvantageous in that dust is apt to adhere to contact portions of the contact elements, because the contact elements are open to the surrounding atmosphere. In addition, a voltage is applied to the contact portions during actuation and further promotes the adhesion of dust to the contact portions. Resistance therefore builds up due to contact failure or poor conduction at the contact portions. Thus, the conventional leaf switch cannot effectively switch when a low current is flowing.

SUMMARY OF THE INVENTION

The present invention enables the provision of a sealing-type cover construction for a leaf switch which is capable of enclosing at least part of a contact mechanism of the leaf switch in such a manner as to allow switching to be effected from outside the cover construction, thereby effectively to prevent dust entering the contact mechanism, while allowing the leaf switch to switch effectively.

In accordance with the present invention, there is provided a cover suitable for a leaf switch having at least two contact elements which cover comprises a cover body defining an internal space of a size sufficient to receive at least a portion of the contact elements of the leaf switch, and means for engagement with a movable one of the contact elements such that movement of the cover causes the movable contact element to move into or out of contact with a second one of the contact elements.

The invention also extends to cover for a leaf switch which is adapted to sealedly enclose spring-loaded contact elements disposed in parallel with one another and embedded at a portion thereof in an insulating base of the leaf switch except the base portion of the contact elements adjacent to the insulating base, the cover comprising a cover body formed therein with an internal space which has a size sufficient to receive therein the portion of the contact elements to be covered, the cover body being connected thereto a movable spring-loaded contact element of the contact elements so that the movable contact element may be moved in co-operation with movement of the cover body to actuate contacts provided on the contact elements when an external force is applied to the cover body and the cover body receiving a fixed spring-loaded contact element of the contact elements therein so that the fixed contact element may be kept immovable when the movable contact element is moved in co-operation with the cover body.

A cover in accordance with the present invention allows the fixed contact element of the switch to be immovable and kept at its original position. Also, when an external force is applied to the cover, the cover body and the movable contact element can be moved together in the direction of the force. Thus, when a cover in accordance with the present invention is used for a normally open leaf switch, a contact of a movable contact element is moved to a contact of a fixed contact element, thereby closing the switch, when an external force is applied. On the other hand, when a cover in accordance with the invention is used for a normally closed leaf switch, a contact of a movable contact element which is in contact with a contact of a fixed contact element is separated from the fixed contact, thereby opening the leaf switch, when an external force is applied.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
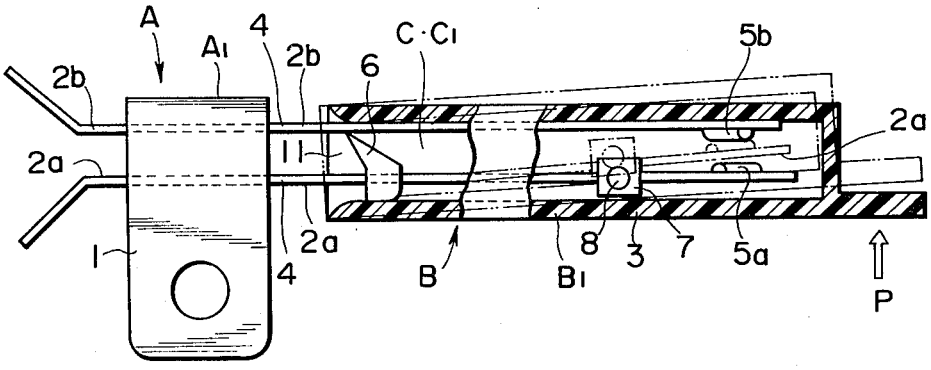
FIG. 1 is a partially broken front view of one embodiment of a cover for a leaf switch according to present invention in which a normally open leaf switch is sealed and enclosed.
Figure 2:
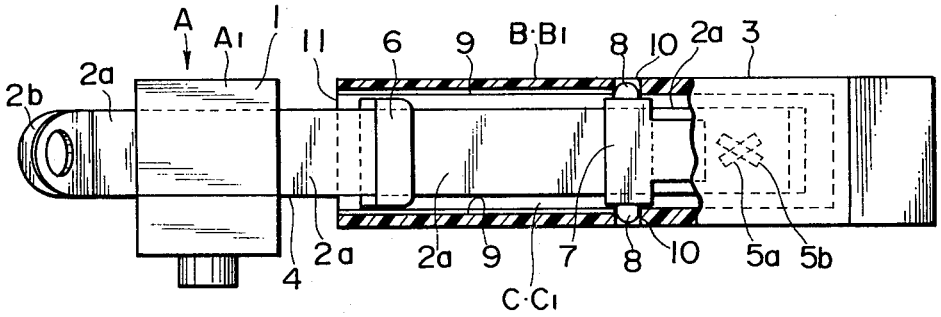
FIG. 2 is a partially broken bottom view showing the cover having the leaf switch shown in FIG. 1 enclosed in it.
Figure 3:
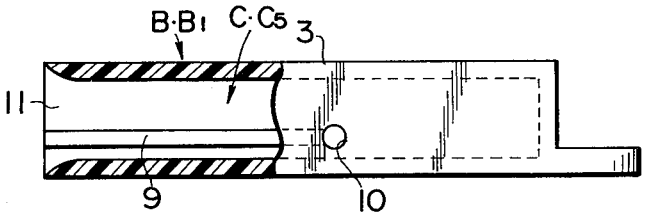
FIG. 3 is a partially broken front view showing a cover body of the cover of FIGS. 1 and 2.

FIGS. 1 to 3 illustrate one embodiment of a cover for a leaf switch according to the present invention, in which a leaf switch and a cover are respectively designated by reference characters A and B. In this embodiment, a normally open leaf switch is used as the leaf switch A, which is constructed in such a manner that contacts 5*a* and 5*b*, which are provided on a movable spring-loaded contact element 2*a* and a fixed contact element 2*b* respectively, are separated from each other so that the switch is normally open. The contacts 5*a* and 5*b* meet to close the switch by pressing the movable contact element 2*a* against the fixed contact element 2*b*. It is, of course, apparent that a leaf switch to be sealed and enclosed by a cover constructed of the present invention does not have to be one which is normally open. The leaf switch A also includes an insulating base 1 which acts to support the contact elements 2*a* and 2*b* and to space them apart from each other.

The cover B of the present invention is adapted substantially to enclose most of the contact elements 2*a* and 2*b*, apart from the base portion 4 adjacent the insulating base 1. The cover B includes a cover body 3 which defines an internal space C of rectangular section and of a length corresponding to the portion of each contact element to be enclosed. The cover body 3 has a separator 6 inserted in the space C and positioned adjacent the entrance portion 11 of the space and acts to space the contacts elements 2*a* and 2*b* apart from each other. One part of the separator 6 is fitted on the movable contact element 2*a* and the other end abutts against the fixed contact element 2*b*. The cover body 3 also has an engaging or contacting member 7 inserted in the space C and fitted on the movable contact element 2*a*. The connecting member 7 is positioned around an intermediate portion of the space C and has small hemispherical projections 8 formed on both sides thereof. The separator 6 and connecting member 7 may be formed of a substantially rigid insulating plastics material using an insert moulding procedure. The cover body 3 has at a lower portion of the both inside surfaces a pair of small holes or recesses 10 in which the projections 8 of the connecting member 7 are fitted to hold the connecting member 7 with respect to the cover body 3. In this manner the movable contact element 2*a* is connected to or engaged with the cover body through the agency of the connecting member 7. The cover body 3 also has, on its inside surfaces, a pair of grooves 9 horizontally extending from the entrance portion 11 of the space C to the holes 10, which act to guide the projections 8 of the connecting member 7 to the holes 10 so as to position the member 7 in place. The separator 6 and connecting member 7 are inserted in the space C together with the contact elements and allow the cover $B_1$ to be detachably fitted on the contact elements.

The separator 6, as mentioned above, is adjacent the entrance portion 11 of the space $C_1$. The separator 6 acts to space the contact elements 2*a* and 2*b* from each other and acts as a strut effectively to hold the cover $B_1$ with respect to the contact elements 2*a* and 2*b*. More importantly, the separator 6 acts as a partition for closing the entrance portion 11 of the space $C_1$ to seal the space from the atmosphere, thereby effectively to prevent dust from entering the space $C_1$.

When an external force P is applied to the cover B, both it and the movable contact element 2*a*, which is associated with the cover B through the connecting member 7, are moved together to allow the movable contact 2*a* to contact the fixed contact element 5*b*. When the external force P is removed, the cover B and contact element 2*a* return to their original position and thereby open the switch.

Figure 4:
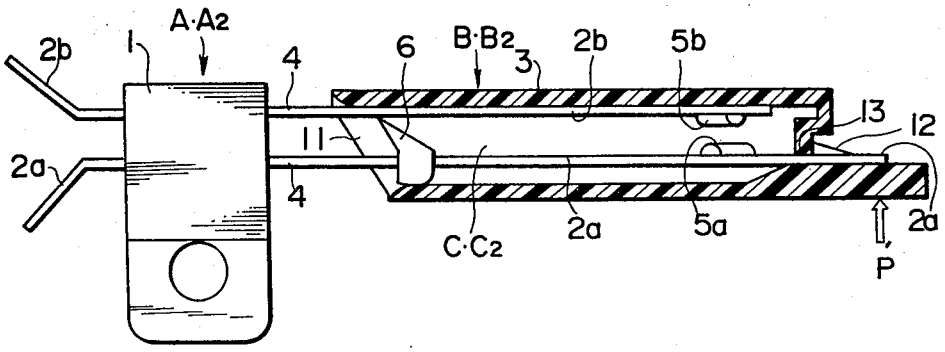
FIG. 4 is a partially broken front view of a second embodiment of a cover for a leaf switch according to the present invention in which a normally open leaf switch is sealed and enclosed.
Figure 5:
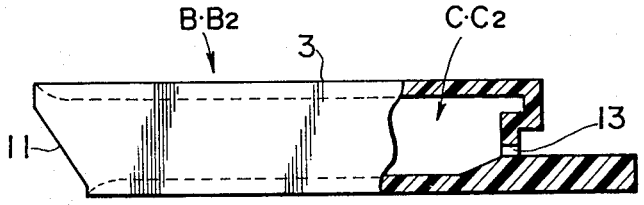
FIG. 5 is a partially broken front view showing a cover body of the cover of FIG. 4.

FIGS. 4 and 5 illustrate a second embodiment of a cover for a leaf switch according to the present invention, in which a leaf switch $A_2$ is normally open as in the first embodiment. A cover $B_2$ of the second embodiment includes a cover body 3 defining internal space $C_2$ which is retangular in section. The length of the space $C_2$ corresponds to the length of the portion of movable and fixed spring-loaded contact elements 2*a* and 2*b* to be covered. The space $C_2$ has a separator 6 inserted and positioned in it in substantially the same manner as in the first embodiment. The tip of the movable contact 2*a* of the leaf switch has a resilient pawl 12 and the tip of the cover body 3 has a slit 13 communicating with the space $C_2$. The size of the slit 13 is sufficient to allow the end portion of the contact element 2*a* to pass through it. The cover $B_2$ is fitted over the contact elements 2*a* and 2*b* by inserting the contact elements through the entrance portion 11 of the space $C_2$ and guiding the resilient pawl 12 through the slit 13 to the outside of the cover body 3. The resilient pawl 12 engages with the outer wall of the cover body. The removal of the cover $B_2$ can be easily accomplished by pressing the resilient pawl 12 and pulling off the cover body.

The separator 6 in the second embodiment acts to support the contact elements 2*a* and 2*b* in a manner to space the elements from each other and acts as a strut to facilitate the fitting of the cover $B_2$ on the contact elements 2*a* and 2*b*. In addition, the separator 6 acts as a partition for closing the entrance portion 11 of the space $C_2$ to seal the space from the atmosphere, thereby effectively to prevent dust from entering the space $C_2$.

Figure 6:
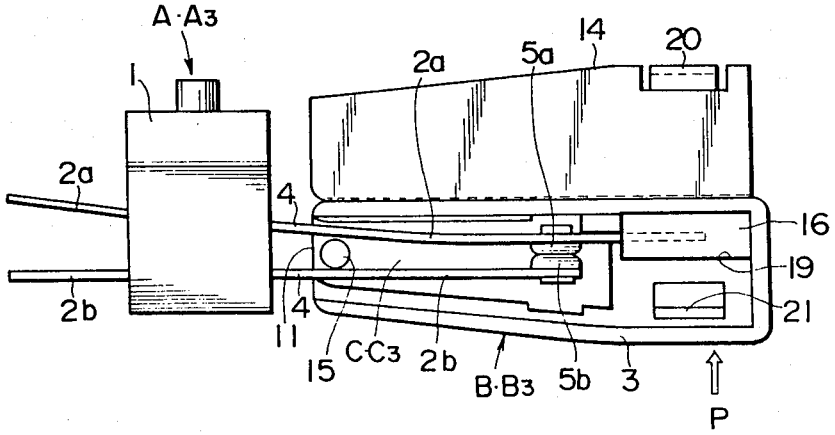
FIG. 6 is a front view illustrating a third embodiment of a cover according to the present invention in which a normally closed leaf switch is enclosed and a lid member of the cover is open.
Figure 7:
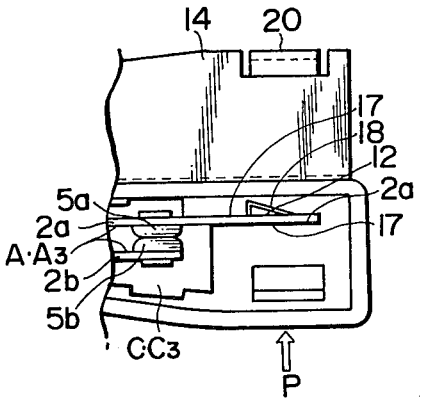
FIG. 7 is a partial front view showing a modification of the third embodiment shown in FIG. 6 in which a normally closed leaf switch having a resiliently projecting pawl provided at the end of a movable contact element is sealed and enclosed.

A third embodiment of a cover for a leaf switch according to the present invention is illustrated in FIGS. 6 and 7. A leaf switch $A_3$ in this embodiment is normally closed, which is to say that it is constructed in a manner such that contacts 5*a* and 5*b*, of movable and fixed spring-loaded contact elements 2*a* and 2*b* respectively, normally contact each other to keep the switch closed.

Contact is broken to open the switch by applying an external force P to the movable contact element 2a through a cover $B_3$ to separate the movable contact element 2a from the fixed element 2b. The cover $B_3$ of this embodiment is adapted substantially to enclose the contact elements 2a and 2b of the leaf switch apart from the base portion 4 adjacent an insulating base 1 of the leaf switch.

Figure 8:
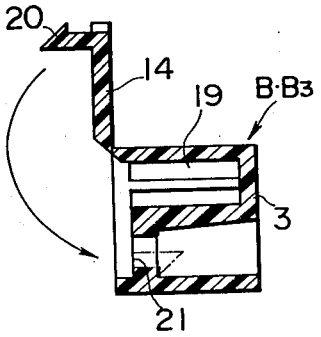
FIG. 8 is a sectional view showing the cover of FIG. 6 in which the lid member is opened.
Figure 9:
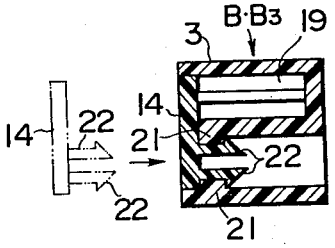
FIG. 9 is a sectional view showing another modification of the cover shown in FIG. 6 which has a lid member separated from a cover body.

The cover $B_3$ comprises a cover body 3, which is rectangular in section, and a lid member 14. The cover body 3 defines an internal space $C_3$ which is rectangular in section and whose length corresponds to the portion of the contact elements 2a and 2b to be covered. The space $C_3$ has a projection 15 acting as a separator provided near the entrance portion 11. The upper portion of the tip of the cover body 3 has a chamber 19 (FIGS. 6 and 8) or a groove 17 having a recess (FIG. 7). The recess is adapted either to receive an insulating enclosure 16 provided round the tip end of the movable contact element 2a or to receive the tip end of the element 2a having a resilient pawl 12. The lid member 14 is hinged at one of its sides to one side of the cover body and is provided at the other side with a pawl element 20 which is adapted to engage a projection 21 formed on the other side of the cover body (FIG. 8). Thus the space $C_3$ can be covered by the lid member 14. Alternatively, the lid member 14, as shown in FIG. 9, may be separated from the cover body and provided with legs 22 which engage projections 21 of the cover body.

The way in which the cover $B_3$ is fitted on the leaf switch will now be explained.

The contact elements 2a and 2b are inserted from the entrance portion 11 into the space to fit the enclosure 16 of the contact element 2a, or the resilient pawl 12 of the element 2a as the case may be, into the chamber 19, or the recess 18, of the groove 17 and to allow the separator 15 to be interposed between the contact elements 2a and 2b. This results in the movable contact element 2a being connected to cover $B_3$ so as to be movable together with the cover body 3. Then the cover body 3 is covered by the lid member 14 by engaging the pawl element 20 or the legs 22 with the projection(s) 21. Thus, the contact elements 2a and 2b are hermetically enclosed by the cover construction $B_3$ because the space $C_3$ is sealed from the surrounding atmosphere by the separator 15.

The application of an external force P to the cover $B_3$ allows both the cover B and the movable contact element 2a connected with it to be deflected, so that a movable contact 5a, breaks contact with a fixed contact 5b to open the switch. When the force P is removed, the cover $B_3$ and the movable contact element 2a return to their original position.

Figure 10:
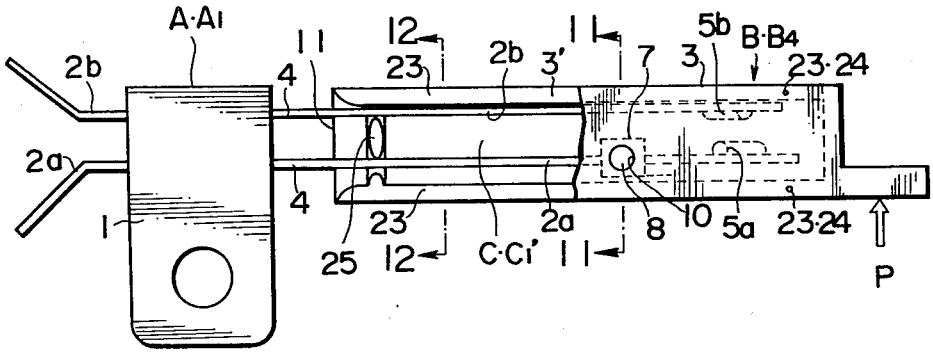
FIG. 10 is a partially broken front view of a fourth embodiment of a cover according to the present invention of which a cover body comprises two halves divided in the longitudinal direction.
Figure 11:
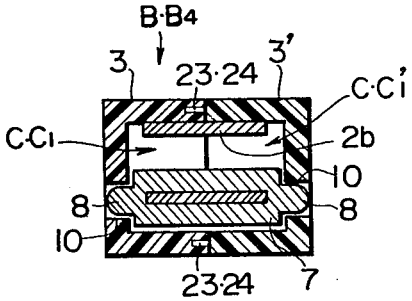
FIG. 11 is a sectional view taken along the line 11—11 of FIG. 10.
Figure 12:
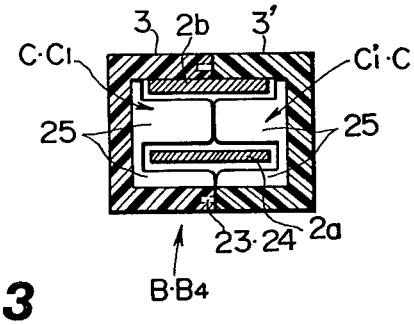
FIG. 12 is a sectional view taken along the line 12—12 of FIG. 10.

A cover in accordance with the present invention may be formed by two halves divided in the longitudinal direction. FIGS. 10 to 12 illustrate a fourth embodiment of a cover for a leaf switch according to the present invention. In this embodiment, a leaf switch is used which is similar to the one described in the first embodiment. The cover body is divided into two halves 3 and 3' in the longitudinal direction and a space C is also divided into halves $C_1$ and $C_1'$. The cover $B_4$ is formed by inserting contact elements 2a and 2b in one half $C_1'$ of the space C and adhesively mating the halves 3 and 3' of the cover body with each other or snugly fitting a projection of the half 3' in a recess of the other half 3. In this embodiment, the cover body is provided with small holes 10 for receiving projections 8 of a connecting member 7; however, grooves on the inside surfaces of the cover body corresponding to the grooves 9 of the first embodiment do not have to be provided. The present embodiment may be constructed such that a grooved partition 25 is integrally connected to at least one of the halves 3 and 3' of the cover body adjacent the entrance portion 11 of the space C, so that a discrete separator, such as the separator 6 of the first embodiment, need not be provided.

It is of course clear that the cover $B_4$ can be applied to other types of leaf switches by suitable modification.

Figure 13:
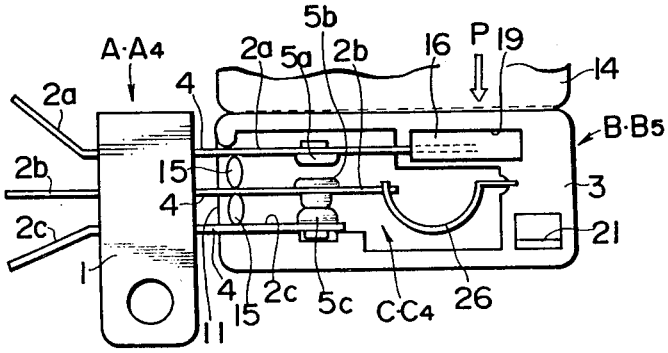
FIG. 13 is a front view of a fifth embodiment of a cover according to the present invention in which a two-way leaf switch is sealed and enclosed.

FIG. 13 illustrates a fifth embodiment of a cover according to the present invention, in which a leaf switch $A_4$ is a two-way leaf switch and has three contact elements 2a, 2b and 2c. The two-way leaf switch $A_4$ is constructed in such a manner that when an external force P is applied to the movable contact element 2a through a cover construction $B_5$ to move the contact element 2a, the contact element 2a presses and reverses an arcuate spring 26 of the contact element 2b to force the contact element 2b toward the contact element 2a. A contact 5b of the contact element 2b thus breaks contact with a contact 5c of the fixed contact element 2c and makes contact with a contact 5a of the movable contact element 2a.

Figure 14:
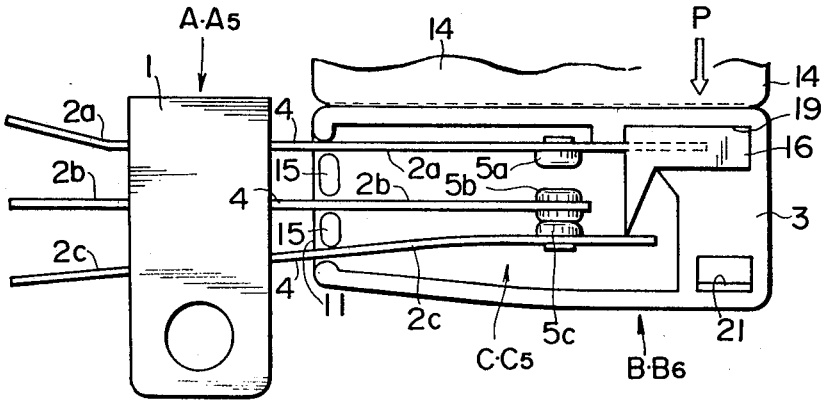
FIG. 14 is a front view showing a modification of the embodiment shown in FIG. 13.

FIG. 14 shows a modification of the fifth embodiment shown in FIG. 13, which is also adapted to enclose a two-way leaf switch. A cover $B_6$ shown in FIG. 14 is constructed so that, when a force P is applied to it to move a movable contact element 2a, a contact 5a of the movable contact element 2a makes contact with a contact 5b of a contact element 2b and an indenter 16 of the element 2a forces a contact element 2c to break contact between the contact 5c and the contact 5b.

Each of the covers $B_5$ and $B_6$ shown in FIGS. 13 and 14 is constructed and fitted on the leaf switch in the substantially same manner as the covers $B_3$ shown in FIG. 6.

A cover in accordance with the present invention may also be used with other leaf switches constructed in such a manner that a plurality of spring-loaded contact elements are embedded in an insulating base of the leaf switch.

Figure 15:
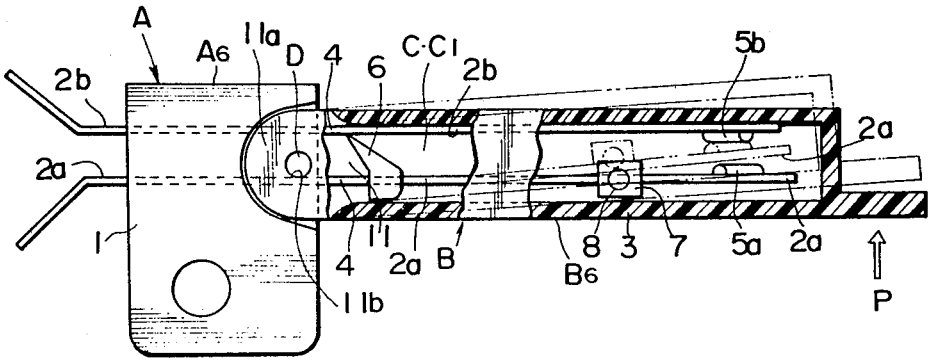
FIG. 15 is a partially broken front view of a sixth embodiment of a cover according to the present invention which is adapted to be pivotably connected with respect to an insulating base of a leaf switch.
Figure 16:
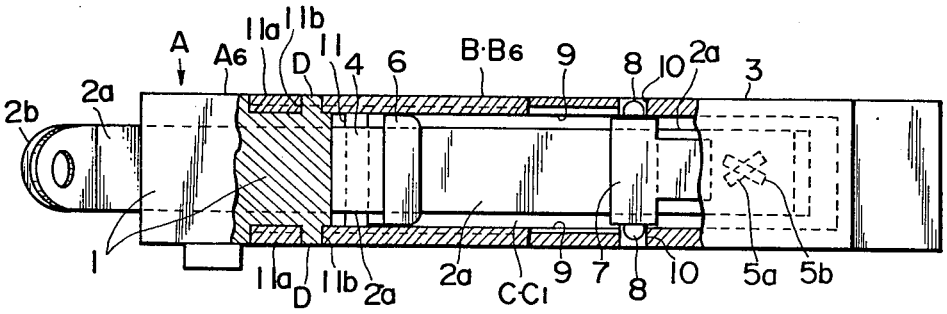
FIG. 16 is a partially broken bottom view of the cover shown in FIG. 15.
Figure 17:
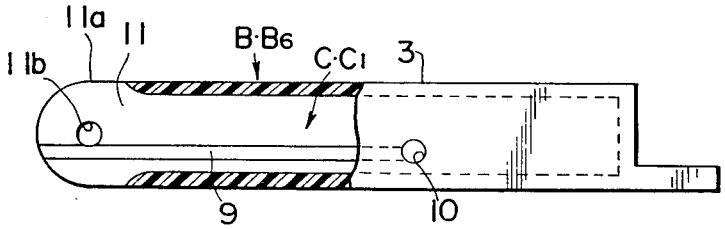
FIG. 17 is a partially broken front view showing a cover body of the cover shown in FIG. 15.

A cover in accordance with the present invention can be pivotally connected at the entrance portion of the space which it defines with respect to an insulating base of a leaf switch, as shown in FIGS. 15 and 17. In this embodiment, a semi-circular protrusion 11a is formed at the end of each side wall of a cover body 3 so as to extend beyond the entrance portion 11 of a defined space $C_1$. Holes 11b extend through the protrusions 11a and receive pins D provided on both sides of the insulating base 1 of the switch. Thus the cover $B_6$ may be connected to the insulating base so that it is rotatable with respect to the base 1 and with respect to a fixed spring-loaded contact element 2b. It is also possible to construct the cover in such a manner as to provide the pins D on the inner surface of the protrusions 11a and to form the holes 11b in the both sides of the insulating base; thereby the cover $B_6$ will be rotatably connected to the insulating base. It will be noted that in this embodiment the cover $B_6$ is pivotably and detachably connected, at the portion thereof adjacent the entrance portion 11, to the insulating base. In the sixth embodiment illustrated, the rotatable cover $B_6$ is fitted on a normally open leaf switch as shown in FIG. 1; however, the rotatable cover $B_6$ can also be fitted on such leaf switches as are shown in FIGS. 4, 6, 10 and 13.

It should be noted that a cover for a leaf switch in accordance with the present invention is not limited to such embodiments as explained hereinbefore. In such a cover, it is appropriate that the space defined in the cover body be of a size sufficient to enclose at least a portion of the contact elements, for example a portion other than the portion adjacent the insulating base, that the space can receive the contact elements of the leaf switch in the cover body so that the movable contact element may be moved together with the cover body when an external force is applied to the cover, and that the cover preferably keep at least one contact element, other than the movable contact element, immobile when an external force is applied to the cover.

In view of the foregoing, it will be understood that a cover in accordance with the present invention can enclose the leaf switch and seal off a large portion of the spring-loaded contact elements, including their contact portions from the surrounding atmosphere. This arrangement may eliminate the disadvantage of the contact portions being contaminated with dust yet allowing the leaf switch to switch satisfactorily.

Obviously, many modifications and variations of the present invention are possible in the light of the above teachings. It is therefore to be understood that, within the scope of the appended claims, the invention may be practiced otherwise than as specifically described.

What is claimed as new and desired to be secured by Letters Patent of the United States is:

1. A cover for a leaf switch having at least one movable and one fixed contact elements comprising:

a rigid, enclosed cover body defining an internal space, opened at one end adapted to receive said contact elements in the internal space through said open end; and means for engagement with said movable contact element, said engagement means fixedly coupled to said cover body such that movement of said cover body causes said movable contact element to move into or out of contact with said fixed contact element.

2. The cover as defined in claim 1, wherein said cover is provided with sealing means for forming a substantially dust-tight seal between said defined internal space and the atmosphere.

3. The cover as defined in claim 1, wherein said engagement means comprises at least one or more holes for engaging with one or more corresponding protrusions on a connecting member connected to said movable contact element.

4. The cover as defined in claim 3, wherein said cover body is provided with one or more longitudinal recesses for guiding the or each protrusion to said corresponding hole.

5. The cover as defined in claim 1, wherein said engagement means comprises a slit at one end of said cover body into which slit a free end portion of said movable contact element can extend.

6. The cover as defined in claim 1, wherein said cover body comprises a box member and a lid member.

7. The cover as defined in claim 6, wherein said engagement means comprises a groove, in said box member, for receiving a portion of said movable member.

8. The cover as defined in claim 6, wherein said box member is hinged to said lid member and can also engage with said lid member by means of a protrusion on said box member or said lid member.

9. The cover as defined in claim 6, wherein said box member comprises a projection for separating a portion of said movable contact member from the or another contact member.

10. The cover as defined in claim 6, wherein said lid member is detatchable from said box member and can be attached to said box member by means of one or more leg members, on one of said lid member and said box member, adapted to engage with one or more projections, on the other of said lid member and said box member.

11. The cover as defined in claim 1, wherein said cover body is formed by mating two halves, substantially along a longitudinal plane and wherein said cover body has a grooved partition integrally provided at an entrance of said defined space.

12. The cover as defined in claim 11, wherein said two halves are mated by adhesive.

13. The cover as defined in claim 11, wherein said two halves are mated by means of a recess on one half and a projection on the other half.

14. The cover as defined in claim 1, wherein said cover body is rotatable with respect to an insulating base for said contact elements.

15. The cover as defined in claim 14, wherein said cover body has one or more semi-circular protrusions provided at an entrance of said defined space, each protrusion being provided with a hole for receiving a pin of said insulating base.

* * * * *